United States Patent [19]

Peytavin

[11] 4,175,414

[45] Nov. 27, 1979

[54] SMOOTHING ROLLING MILL

[75] Inventor: Pierre Peytavin, Neuilly-sur-Seine, France

[73] Assignee: Vallourec (Usines a Tubes de Lorraine-Escaut et Vallourec Reunies), Paris, France

[21] Appl. No.: 879,808

[22] Filed: Feb. 21, 1978

[30] Foreign Application Priority Data

Feb. 25, 1977 [FR] France ..... 77 05566

[51] Int. Cl.[2] ..... B21B 19/10

[52] U.S. Cl. ..... 72/96; 72/100

[58] Field of Search ..... 72/77, 78, 95, 96, 98, 72/99, 100

[56] References Cited

U.S. PATENT DOCUMENTS

| | | | |
|---|---|---|---|
| 293,165 | 2/1884 | Haas | 72/100 |
| 1,076,545 | 10/1913 | Blaxter | 79/96 |
| 1,141,427 | 6/1915 | Simpkins | 72/95 |

*Primary Examiner*—Lowell A. Larson

*Attorney, Agent, or Firm*—Brisebois & Kruger

[57] ABSTRACT

A smoothing rolling mill having identical frusto-conical smoothing rollers mounted on axes inclined to the axis of displacement of a tube blank passing between the rollers. The axes of the rollers converge in the direction of displacement of the tube blank. The tube blank is rotated and displaced axially between the smoothing rollers in a conventional manner. If desired, the shafts which mount the rollers for rotation can be pre-loaded with respect to the tube blank.

7 Claims, 3 Drawing Figures

13
12
P
14
12
9
8
13
11
13
A
A
D
16
8
13
11
13
1
12
P
15
12
10
13
11
13

SMOOTHING ROLLING MILL

SUMMARY OF THE INVENTION

This invention is related to application in France Ser. No. 77 05566 of Feb. 25, 1977, and the disclosure thereof is incorporated by reference.

The present invention relates to a novel rolling mill smoother for use in the manufacture of seamless metal tubes.

One had already used rolling mill smoothers designed to reduce, as much as possible, uneveness in the wall thickness of a tube blank, previously rolled, notably in a "Stiefel" type rolling-mill, that is, a rolling-mill having one or plural pairs of grooved rollers, in which a blank coming out of a rolling-mill piercer is rolled on a mandrel held at the end of a bar.

Applicant has described in its copending application Ser. No. 759,660, now U.S. Pat. No. 4,091,650, a new "Stiefel" type rolling-mill preferably having two pairs of rollers, the axes of rotation of one of the pairs of rollers being in a plane orthogonal (at right angles) to the plane of the axes of rotation of the other pair of rollers, in a rolling-mill in which the thickness of the tube blanks obtained can be controlled more precisely. In the above mentioned patent application, is also described an installation for manufacture of seamless tubes in which the tube blank coming from such an improved "Stiefel" type rolling-mill is smoothed or polished in smoother rollers.

A smoother rolling mill of the conventional type generally has two essentially identical smoothing rolls positioned symmetrically in relation to the axis of displacement of the tube blank, and rotatable about axes parallel to the axis of displacement of the tube blank, a mandrel fixed at the end of a mandrel rod going through the tube blank axially and generally being kept fixed between the rolls while the blank is displaced axially during the rolling. Such a smoothing mill has means to rotate the tube blank about its own longitudinal axis at high speed, this speed commonly being in the order of 1000 revolutions/minute or greater, and the smoothing mill has means to displace this blank longitudinally.

Before going through the smoothing mill, the blank coming from a "Stiefel" rolling-mill, has two diametrically opposite bulges formed by an increase in thickness of the walls of the blank, and corresponding to the compression of the metal making up the walls of the blank into the space between the rolls of the "Stiefel" rolling-mill near the lateral edges of the roll grooves.

The smoothing rollers are precisely designed to eliminate these increased thicknesses so that the tube coming from the smoothing rollers should have an essentially uniform thickness.

In conventional rolling-mill smoothers in which the smoothing rolls have a cylindrical shape whose generatrices are parallel to the longitudinal axis of displacement of the blank, very violent forces are exerted on the mandrel, the blank and the rolls at each pass of the bulges which present the blank in contact with the rollers, especially because the generatrices of the rollers are only in contact with the exterior surface of the blank over a short portion of their length. Considering the high rotational speeds of the blank, significant vibrations result in the rolling mill assembly, causing relatively rapid wear of the mandrels and of the rolls and risking damage to the rolling-mill smoother assembly.

The present invention aims to realize a rolling-mill smoother for procuring a more progressive rolling of the blank than in conventional smoothing rolling mills, which is less subject to vibrations than conventional rolling mills, and which produces a smoothed tube or blank of high quality.

The rolling-mill smoother of the present invention is essentially characterized by the fact that each of the smoothing rollers has essentially the shape of a frustum of a cone of revolution, whose lateral surface, which comes in contact with the blank, is joined to the surfaces of the roller extremities by zones of curved section, the smoothing rollers being mounted to rotate on shafts inclined in relation to the axis of displacement of the tube blank and convergent in the direction of displacement of the blank.

The generatrix generating the lateral surface of each of the smoother rollers is preferably a straight line, but as a variation it would be possible for it to have a slightly incurvated shape.

Thus it is understood that due to such a configuration and such an arrangement of the smoothing rollers, the generatrices of the rollers, to the extent to which they are inclined in relation to the axis of displacement of the blank, come in contact over a major part of their length with the generatrices of the blank at its bulges, which insures a more progressive rolling of the walls of the blank at the bulges and with peripheral speeds of the blank and of the smoothing rollers essentially uniform over the length of the contact area.

With the object of reducing still more vibrations and the influences undergone by the different elements of the rolling-mill smoother, it is advantageous according to the invention to provide means to exert a prestress on each of the shafts supporting the smoother rollers, in a direction separating each of the shafts from the axis of displacement of the blank, the prestress being exerted after engaging the blank between the smoother rollers, which already produces a certain spacing of the shafts carrying the smoother rollers away from the axis of displacement of the blank. The prestress exerted on the shafts allows them to be maintained essentially in the position caused by the insertion of the blank between the smoother cylinders.

In another embodiment of the present invention means are provided to axially displace the mandrel bar during the rolling phase in such a way that the mandrel slides in relation to the tube blank when the blank passes between the smoothing rollers. This displacement can be carried out in such a way that the mandrel is made to slide in the direction of the advance of the tube, in which case it is suitable to provide a mandrel of great length, or make the mandrel slide in relation to the blank in a back-and-forth movement, so it reciprocates.

Apparatus disclosed in U.S. Pat. No 4,091,650 can be used for this purpose.

The rolling-mill smoother of the present invention also advantageously has means, after rolling of the blank, to displace the bar which carries the mandrel out of the path of the longitudinal displacement of the blank and to position a new mandrel bar assembly in the mill for the purpose of smoothing the next blank.

The displacement of the mandrel-bar of the mandrel assemblies can be carried out laterally in relation to the longitudinal axis of displacement of the blanks or can also be effected according to a curved path in a known manner, for example a circular path. The mandrel withdrawn from the blank is cooled for the purpose of being reused for a later smoothing operation or is replaced by a new mandrel.

Apparatus according to U.S. Pat. Nos. 3,762,201 or 3,955,392 can be used for this purpose.

An embodiment of the invention will now be described as an example, in no way limiting, in order to make the invention better understood.

DESCRIPTION OF PREFERRED EMBODIMENT

Figure 1:
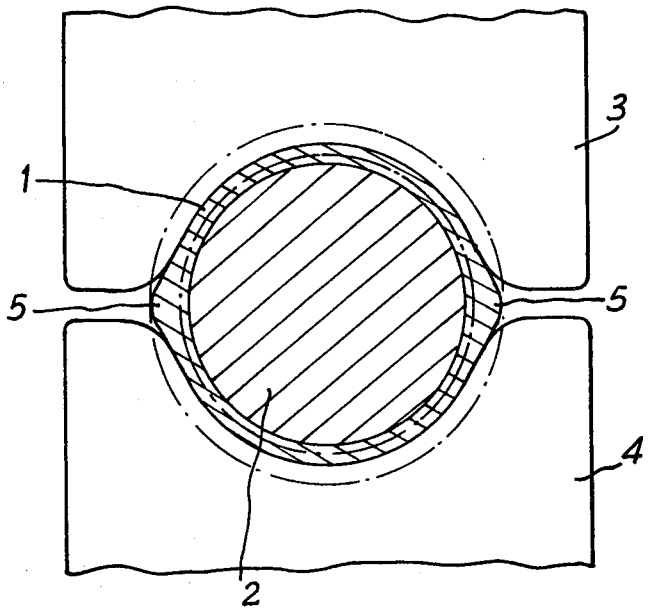
FIG. 1 shows a tube blank in a first cage of a "Stiefel" rolling-mill.

FIG. 1 shows a rolled tube blank 1 around a mandrel 2 between grooved rollers 3 and 4 of a "Stiefel" rolling-mill cage.

It can be seen that between rollers 3 and 4, increased thicknesses develop forming bulges 5, diametrically opposed, on the exterior surface of the blank.

Figure 2:
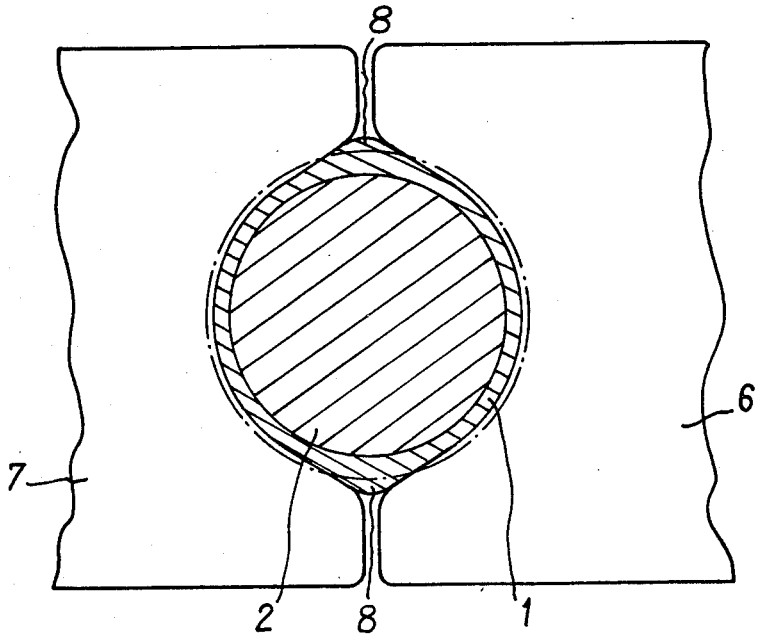
FIG. 2 shows the same blank in the second cage of a "Stiefel" rolling-mill, the axes of the rollers of the second cage being orthogonal to the axes of the rollers of the first cage.

When this blank 1 passes, as can be seen in FIG. 2, into a second cage of the "Stiefel" rolling-mill between grooved rollers 6 and 7, whose axes of rotation are orthogonal in relation to the axes of rollers 3 and 4, increases in thickness constituting bulges 8 develop on the blank, in the zones corresponding to the space between the ends of the grooves of rollers 6 and 7.

A rolling-mill which can produce such a blank is for example of the type described in U.S. Pat. No. 4,091,650 and in which a single mandrel of great length is used during the rolling of the tube blank between the rollers of the two successive cages, at right angles to each other, and in which the mandrel is displaced in relation to the blank during the rolling.

Figure 3:
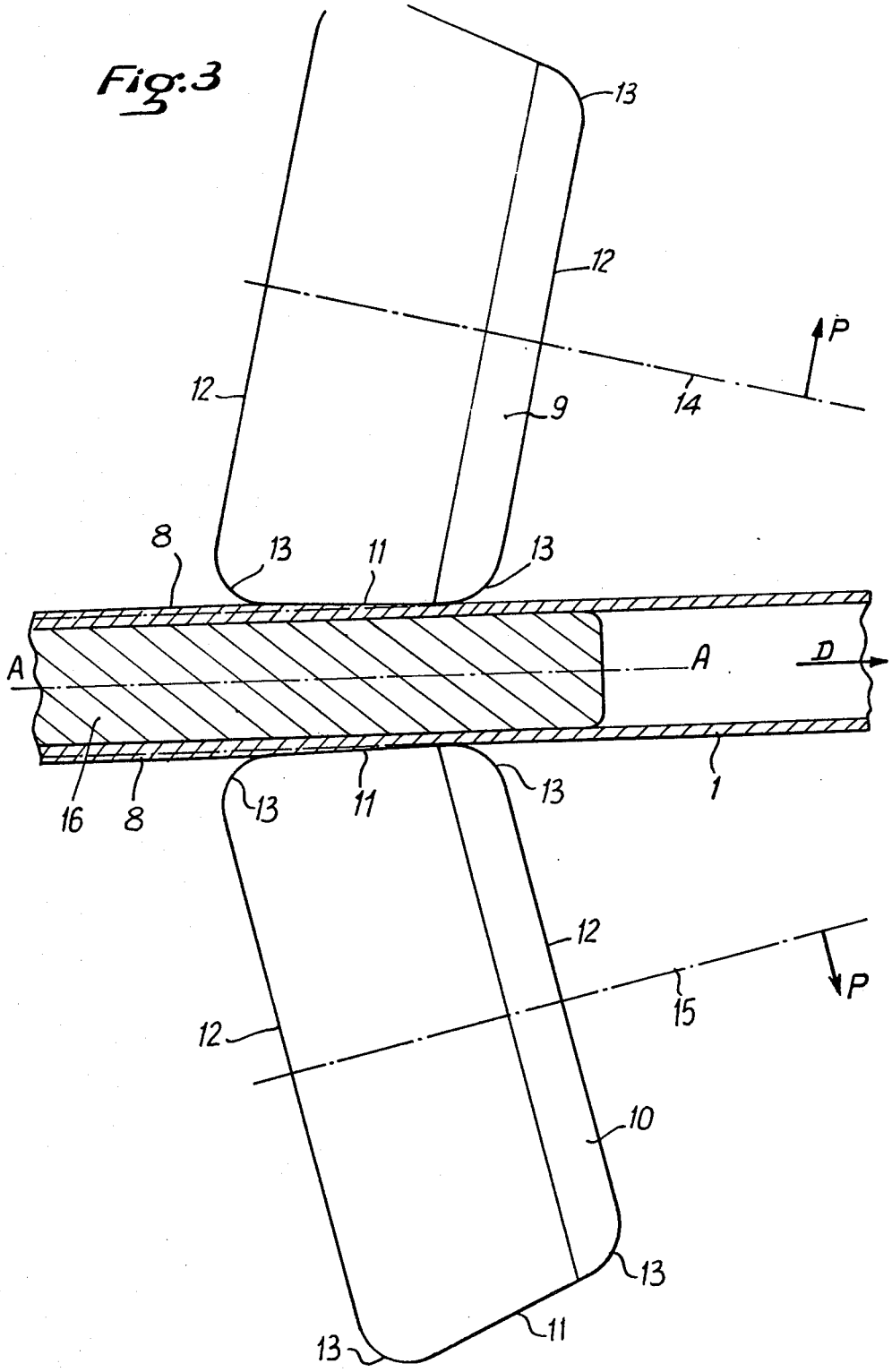
FIG. 3 schematically shows an example of the configuration and the arrangement of the smoothing rollers in a rolling-mill smoother according to the present invention.

The blank coming from such a "Stiefel" rolling-mill and having bosses 8 as described, is passed into a rolling-mill smoother according to the present invention, shown very schematically in FIG. 3.

This rolling-mill has two essentially identical smoothing rollers 9 and 10 each having essentially the shape of a truncated cone whose lateral surfaces, generated by generatrices in the form of straight line segments 11, join with the surfaces of extremities 12, by transition zones of curved section 13. Each of the cylinders 9 and 10 is mounted to rotate around axes 14 and 15 respectively, inclined in relation to the longitudinal axis A—A of blank 1. These axes 14 and 15 converge in the direction of displacement of blank 1, indicated by arrow D in FIG. 3. It must be understood that the angles of inclination shown in the drawing are greatly exaggerated for clarification, these angles in reality being very small, usually on the order of several degrees.

A mandrel 16 is introduced inside blank 1 and is fixed to the extremity of a mandrel bar not shown. Conventional means not shown are provided to rotate blank 1 around its own axis A—A at great speed. Likewise, means are provided to make the blank advances in the direction shown by arrow D.

Means, likewise not shown, are provided to insure the placement and the removal of bars and of mandrels. Means, likewise not shown, can be provided for sliding a mandrel in relation to the blank during rolling, such means for sliding the mandrel in the rolling mill can be analogous to those described in applicant's U.S. Pat. No. 4,091,650.

As has been indicated above, it is desirable to provide means to exert a prestress on each of the shafts carrying rollers 9 and 10, and which shafts are shown schematically by 14 and 15, these prestress forces exerting themselves perpendicularly to these shafts in the direction of arrows P of FIG. 3.

It can be clearly ascertained upon examination of FIG. 3 that during rolling, generatrices 11 of rollers 9 and 10, inclined in relation to axis A—A of the blank are in contact over the major part of their length with the generatrices of blank 1 at bulges 8 when these bulges come in contact with the cylinders. Thus a more progressive rolling is obtained in terms of obtaining a good quality blank of uniform thickness.

Although the invention has been described in context with a particular embodiment, it is obvious that it is in no way limited by the embodiment and that any desirable modification can be made to it without going beyond its scope or intent.

What is claimed is:

1. In a tube smoothing rolling mill having a back up mandrel within a tube blank to be rolled, means for rotating the tube blank about its longitudinal axis, means for displacing the tube axially, and smoothing rollers positioned symmetrically to the axis of displacement of the tube, the improvement comprising, two smoothing rollers positioned diametrically of the tube and each having a tube engaging surface in the form of a frustum of a cone, said surface of each such roller merging with end surfaces of the roller at zones of curved section, and shaft means mounting said rollers for rotation about axes inclined with respect to the axis of displacement of the tube, said axes converging in the direction of displacement of the tube.

2. A rolling mill according to claim 1 further comprising, means to exert a prestress on each of the shafts in a separating direction from the axis of the tube blank after engagement of the blank between the rollers.

3. A rolling mill according to claim 1 further comprising means for axially displacing the back up mandrel with respect to the tube blank during passage of the tube blank between the rollers.

4. A rolling mill according to claim 3 comprising means for sliding the back up mandrel in the direction of advance of the tube blank.

5. A rolling mill according to claim 3 comprising means for reciprocating the back up mandrel with respect to the tube blank.

6. A rolling mill according to claim 1 further comprising means for removing and replacing back up mandrel assemblies for successive tube smoothing operations.

7. A rolling mill according to claim 1 wherein said shaft means comprises a shaft for each roller, said tube engaging surface of each roller is at an angle of only several degrees with respect to the axis of its shaft, and each shaft is inclined with respect to the axis of displacement of the tube at an angle slightly greater than the angle between the tube engaging surface and the axis of its shaft, so that said tube engaging surfaces of the rollers are slightly inclined with respect to the axis of the tube.

* * * * *